US006916081B2

(12) United States Patent
Nakashima

(10) Patent No.: US 6,916,081 B2
(45) Date of Patent: Jul. 12, 2005

(54) CONVEYOR CLEANER AND INK-JET PRINTING APPARATUS INCLUDING IT

(75) Inventor: Atsuhisa Nakashima, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/614,080

(22) Filed: Jul. 8, 2003

(65) Prior Publication Data

US 2004/0114019 A1 Jun. 17, 2004

(30) Foreign Application Priority Data

Jul. 9, 2002 (JP) ..... 2002-199615

(51) Int. Cl.[7] ..... B41J 2/165; B41J 2/01
(52) U.S. Cl. ..... 347/32; 347/104
(58) Field of Search ..... 347/22, 32, 104; 15/256.53; 399/249, 327

(56) References Cited

U.S. PATENT DOCUMENTS 4,530,596 A 7/1985 Kawamoto et al.
5,251,348 A * 10/1993 Corrado et al. ..... 15/256.53
5,964,007 A 10/1999 Wisniewski et al.
2002/0051652 A1 5/2002 Heno

FOREIGN PATENT DOCUMENTS

| | | |
|---|---|---|
| EP | 0 852 345 A2 | 7/1998 |
| JP | A 5-169696 | 7/1993 |
| JP | A 11-73070 | 3/1999 |
| JP | A 2000-313153 | 11/2000 |

* cited by examiner

*Primary Examiner*—Shih-Wen Hsieh
(74) *Attorney, Agent, or Firm*—Oliff & Berridge, PLC

(57) ABSTRACT

A conveyor cleaner according to the present invention comprises an adhesive layer formed by a viscous body, and a cleaning roller whose circumferential surface is covered with the adhesive layer. The cleaning roller is rotatable with the adhesive layer being in contact with a conveyor face of a conveyor belt. When the conveyor belt 8 is moved downward, the conveyor face of the conveyor belt and the adhesive layer gets into contact with each other. As the cleaning roller is pushed down by the conveyor belt, the insertion member comes to be inserted into the adhesive layer. Driving the conveyor belt in this state rotates the cleaning roller, and dust on the conveyor face is transferred to the surface of the adhesive layer to be removed. Also, the cleaning roller is rotated with the insertion member being inserted into the adhesive layer. Thereby, dust having transferred to the surface of the adhesive layer is caught in the interior of the adhesive layer.

24 Claims, 11 Drawing Sheets

CONVEYOR CLEANER AND INK-JET PRINTING APPARATUS INCLUDING IT

BACKGROUND OF THE INVENTION

1. Field of the Invention

The present invention relates to a conveyor cleaner for cleaning a conveyor for conveying a medium being kept on a conveyor face of the conveyor, and also to an ink-jet printing apparatus including the conveyor cleaner.

2. Description of Related Art

An apparatus is known in which a medium is conveyed with being kept on a conveyor face of a conveyor by electrostatic absorption and in this state, some process is applied to the medium. For example, an ink-jet printer includes therein a conveyor belt. Paper as a print medium is conveyed with being kept on a conveyor face of the conveyor belt by electrostatic absorption. In this state, ink is ejected onto the paper through an ink-jet head to form a desired image on the paper.

In such an apparatus, in use for a long time, dust such as paper dust adhering to the conveyor face gradually increases its amount. This may weaken the holding power for keeping a print medium, e.g. paper, on the conveyor face. Accordingly, such a trouble may occur as paper is not suitably kept on the conveyor face and conveying process cannot be properly performed.

To solve the above problem, a conveyor cleaner may be provided for cleaning the conveyor face to recover the holding power. For this purpose known are various types of conveyor cleaners: for example, a type in which a blade is brought into contact with the conveyor face to scratch dust off; a type in which an absorber roll having absorbed water is brought into contact with the conveyor face to wipe dust off; and a type in which an adhesive sheet is brought into contact with the conveyor face to transfer dust to the sheet.

However, in case of the blade type, dust scratched off is apt to accumulate on the blade. Accumulation of a great deal of dust may deteriorate the cleaning performance of the conveyor cleaner. Therefore, removal of dust from the blade must be frequently performed. In case of the absorber roll type, supply of water to the absorber roll must be frequently performed. In case of the adhesive sheet type, replacement of the adhesive sheet must be frequently performed.

Thus, in the conveyor cleaners of the above-described types, maintenance or replacement of the cleaning member must be frequently performed. There is a problem that the work load for the maintenance or replacement is heavy.

SUMMARY OF THE INVENTION

An object of the present invention is to provide a conveyor cleaner in which replacement of cleaning member need not frequently be performed and time, labor, and cost for maintenance can be decreased, and to provide an ink-jet recording apparatus provided with the conveyor cleaner.

According to an aspect of the present invention, a conveyor cleaner comprises an adhesive layer formed by a viscous body, and a cleaning roller whose circumferential surface is covered with the adhesive layer, wherein the cleaning roller is rotatable with the adhesive layer being in contact with a conveyor fac of a conveyor for conveying a medium.

In the above construction, the cleaning roller can be rotated with the adhesive layer being in contact with the conveyor face of the conveyor. Thereby, dust adhering to the conveyor face of the conveyor is transferred to the surface of the adhesive layer to clean the conveyor face of the conveyor. As a result, the holding power of the conveyor for a medium that has been lowered due to the dust is recovered, and sure and smooth conveyance of a medium by the conveyor is realized. Because the adhesive layer is formed by a viscous body, even if dust is placed in a fine recess on the uneven conveyor face of the conveyor, the adhesive layer can be deformed in accordance with the unevenness of the conveyor face and thus the adhesive layer can enter the recess. Therefore, the adhesive layer can surely catch the dust to remove. In addition, by rotating the cleaning roller with an insertion member or the like being inserted into adhesive layer, dust having been transferred from the conveyor face of the conveyor to the surface of the adhesive layer can get caught in the adhesive layer. Thereby, fresh adhesive appears on the surface of the adhesive layer. Because the adhesive force of the surface of the adhesive layer, i.e., the cleaning performance of the conveyor cleaner, is thus kept good, dust can be stably removed from the conveyor face of the conveyor. Therefore, replacement of member for cleaning needs not frequently be performed. This can decrease time, labor, and cost for maintenance.

According to another aspect of the present invention, a conveyor cleaner comprises a cleaning roller, an adhesive layer formed by a viscous body and covering a circumferential surface of the cleaning roller, and a mechanism for moving at least one of a conveyor and the cleaning roller so that the adhesive layer can be selectively at a position where the adhesive layer is in contact with a conveyor face of a conveyor for conveying a medium and a position where the adhesive layer is separated from the conveyor face of the conveyor.

If a state wherein the adhesive layer covering the circumferential surface of the cleaning roller is in contact with the conveyor face of the conveyor continues for a long time, there may arises a trouble in which part of the adhesive layer is transferred to the conveyor face of the conveyor, or in which the adhesive layer sticks to the conveyor face of the conveyor so that the cleaning roller can not be rotated. According to the above construction, however, the adhesive layer can be brought into contact with the conveyor face of the conveyor only when the conveyor needs to be cleaned. When the conveyor need not be cleaned, the adhesive layer is separated from the conveyor face of the conveyor. Thus, the above trouble can be avoided.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
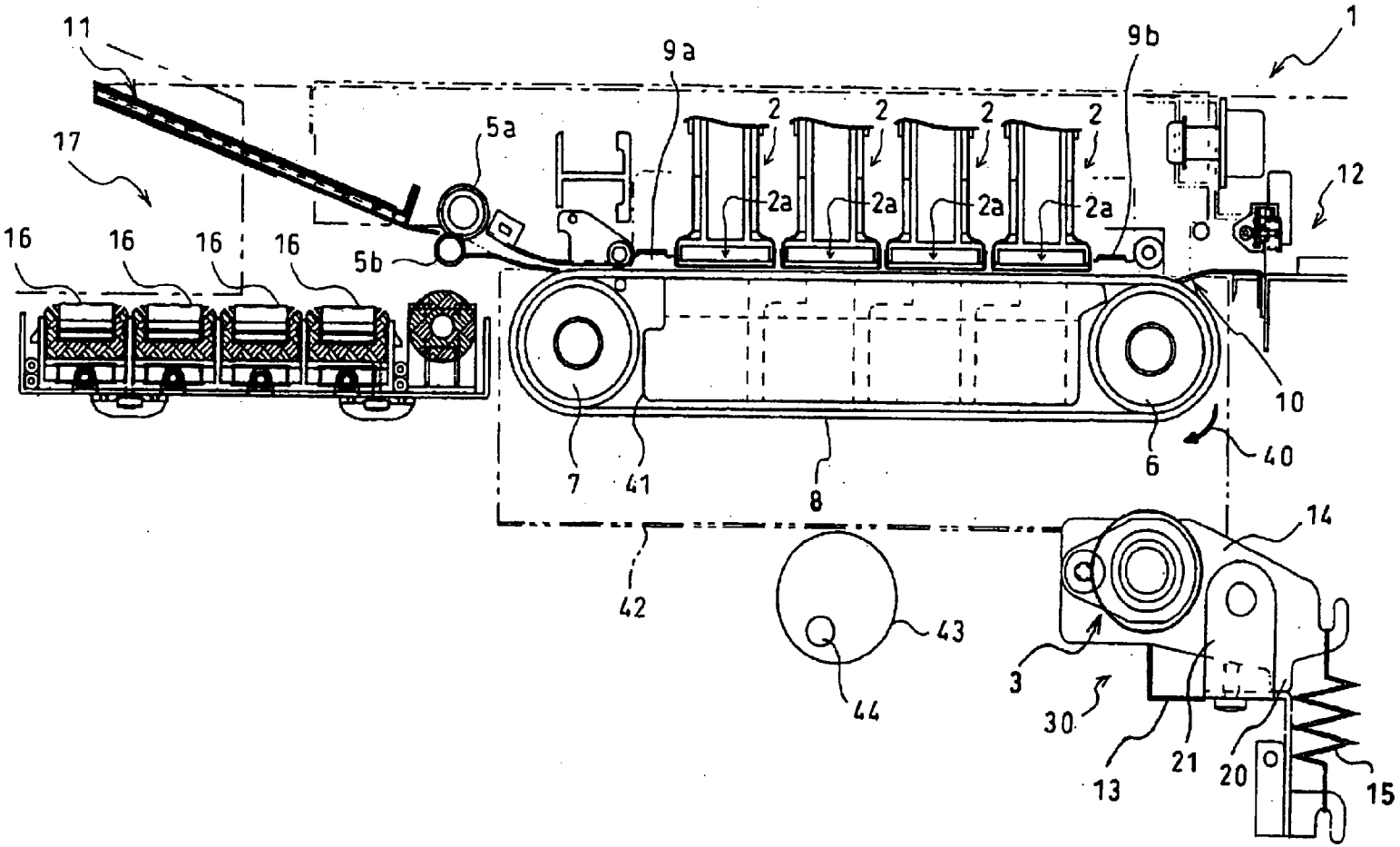
FIG. 1 illustrates a general construction of an ink-jet printer including therein a belt cleaner according to an embodiment of the present invention.

FIG. 1 illustrates a general construction of an ink-jet printer including therein a belt cleaner according to an embodiment of the present invention. The ink-jet printer 1 of this embodiment is a color ink-jet printer having four ink-jet heads 2. Within the ink-jet printer 1, a paper feed unit 11 and a paper discharge unit 12 are provided in left and right portions of FIG. 1, respectively. A paper conveyance path is formed extending from the paper feed unit 11 to the paper discharge unit 12 within the ink-jet printer 1.

A pair of paper feed rollers 5*a* and 5*b* are disposed immediately downstream of the paper feed unit 11 for putting forward paper as a medium from the left to the right in FIG. 1. In the middle of the paper conveyance path, two belt rollers 6 and 7 and a looped conveyor belt 8 as a conveyor are provided. The conveyor belt 8 is wrapped around each of the belt rollers 6 and 7 as to be stretched between them.

The conveyor belt 8 has a two-layered structure made up of a polyester base body impregnated with urethane and a silicone rubber. The silicone rubber is disposed in the outer portion of the conveyor belt 8 to form a conveyor face. Paper fed through the pair of paper feed rollers 5*a* and 5*b* is kept on the conveyor face of the conveyor belt 8 by holding power. In this state, the paper is conveyed downstream, i.e., rightward in FIG. 1, by driving one belt roller 6 to rotate clockwise in FIG. 1 as indicated by an arrow 40.

Pressing members 9*a* and 9*b* are respectively provided at positions for feeding paper onto the conveyor belt 8 and for discharging the paper from the conveyor belt 8, respectively. Either of the pressing members 9*a* and 9*b* is for pressing the paper onto the conveyor face of the conveyor belt 108 so as to prevent the paper from separating from the conveyor face. Thus, the paper is surely kept on the conveyor face.

A peeling device 10 is provided in the paper conveyance path immediately downstream of the conveyor belt 8, i.e., on the right in FIG. 1. The peeling device 10 peels off the paper, which has been kept on the conveyor face of the conveyor belt 8 by holding power, from the conveyor face so that the paper can be transferred toward the rightward paper discharge unit 12.

Each of the four ink-jet heads 2 has, at its lower end, a head main body 2*a*. Each head main body 2*a* has a rectangular section. The head main bodies 2*a* are arranged close to each other with the longitudinal axis of each head main body 2*a* being perpendicular to the paper conveyance direction, i.e., perpendicular to FIG. 1. That is, this printer 1 is a line type. The bottom of each of the four head main bodies 2*a* faces the paper conveyance path. In the bottom of each head main body 2*a*, a large number of nozzles are provided each having a small-diameter ink ejection port. The four head main bodies 2*a* eject ink of magenta, yellow, cyan, and black, respectively.

The head main bodies 2*a* are disposed such that a narrow clearance is formed between the lower face of each head main body 2*a* and the conveyor face of the conveyor belt 8. The paper conveyance path is formed within the clearance. In this construction, while paper, which is being conveyed by the conveyor belt 8, passes immediately below the four head main bodies 2*a* in order, the respective color inks are ejected through the corresponding nozzles toward the upper face, i.e., the print face, of the paper to form a desired color image on the paper.

The ink-jet printer 1 is provided with a maintenance unit 17 for automatically carrying out maintenance of the ink-jet heads 2. The maintenance unit 17 includes four caps 16 for covering the lower faces of the respective head main bodies 2*a*, and a non-illustrated purge system.

The maintenance unit 17 is at a position immediately below the paper feed unit 17 (hereinafter referred to as withdrawal position) while the ink-jet printer 1 operates to print. When the ink-jet printer 1 is expected not to perform printing for a long time, for example, when a state in which no printing operation is performed continues for a predetermined time period or when the ink-jet printer 1 is powered off, the maintenance unit 17 moves to a position immediately below the four head main bodies 2*a* (hereinafter referred to as cap position), where the maintenance unit 17 covers the lower faces of the head main bodies 2*a* with the respective caps 16 to prevent ink in the nozzles of the head main bodies 2*a* from being dried.

The belt rollers 6 and 7 and the conveyor belt 8 are supported by a lifting mechanism including a chassis 42. When the maintenance unit 17 moves between the withdrawal and cap positions, the belt rollers 6 and 7 and the conveyor belt 8 are moved up or down by the lifting mechanism.

The chassis 42 in the lifting mechanism is put on a cylindrical member 43 disposed under the chassis 42. The cylindrical member 43 is rotatable around a shaft 44 provided at a position deviating from the center of the cylindrical member 43. Thus, by rotating the shaft 44, the level of the uppermost portion of the cylindrical member 43 can be changed to move up or down the chassis 42 accordingly. When the maintenance unit 17 is moved from the withdrawal position to the cap position, the cylindrical member 43 must have been rotated at a predetermined angle in advance so as to move down the conveyor belt 8 and the belt rollers 6 and 7 by a pertinent distance from the position illustrated in FIG. 1. A space for the movement of the maintenance unit 17 is thereby ensured.

In the region surrounded by the conveyor belt 8, a nearly rectangular parallelepiped guide 41 having its width substantially equal to that of the conveyor belt 8 is disposed at an opposite position to the ink-jet heads 2. The guide 41 is in contact with the lower face of the upper part of the conveyor belt 8 to support the upper part of the conveyor belt 8 from the inside.

In this embodiment, the belt cleaner 30 is provided just below one belt roller 6. The belt cleaner 30 removes dust such as paper dust generated within the ink-jet printer 1 and adhering to the conveyor face of the conveyor belt 8. Thereby, the belt cleaner 30 recovers the holding power of the conveyor face of the conveyor belt 8 for papers.

Next, a specific construction of the belt cleaner 30 will be described with reference to FIG. 2.

Figure 2:
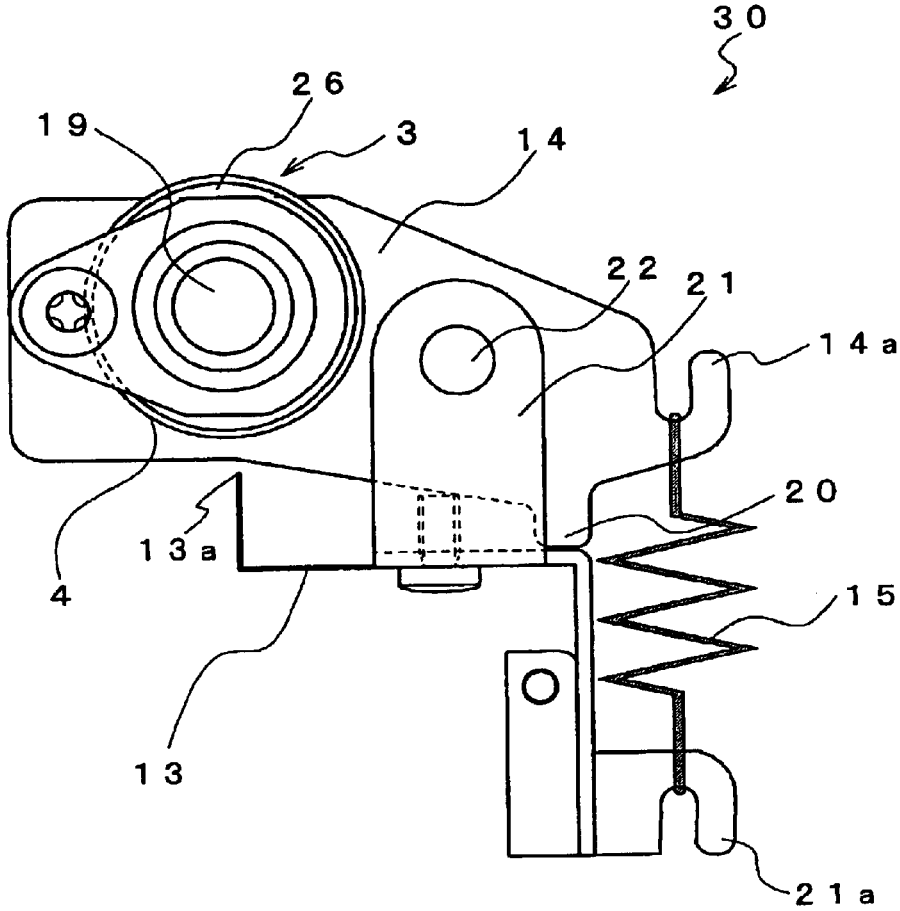
FIG. 2 is an enlarged view of the belt cleaner in the ink-jet printer of FIG. 1.

Referring to FIG. 2, the belt cleaner 30 includes a supporting member 21 fixed to a suitable member of the body of the ink-jet printer 1. The supporting member 21 supports a supporting shaft 22. The supporting shaft 22 supports a middle portion of a swing arm 14. Thereby, the swing arm 14 is freely swingable. The swing arm 14 supports, on its one end, a cleaning roller 3 so as to be freely rotatable around a roller shaft 19.

The cleaning roller 3 includes the roller shaft 19, a roller body 26 as a main body, and an adhesive layer 4 having a thickness of about several millimeters and covering the circumferential surface of the roller body 26. The adhesive layer 4, having viscosity, is made of a suitable adhesive controlled to have an adhesive force stronger than the adhesive force of the conveyor face of the conveyor belt 8. Thus, when the adhesive layer 4 is brought into contact with the conveyor face of the conveyor belt 8, dust adhering to the conveyor face is transferred to the surface of the adhesive layer 4.

A hook portion 14*a* is formed at the other end of the swing arm 14. One end of a biasing spring 15 is engaged with the hook portion 14*a*. The other end of the biasing spring 15 is engaged with a hook portion 21*a* formed on the supporting member 21. The biasing spring 15 always draws downward the hook portion 14*a* of the swing arm 14 and thus always applies a force to the swing arm 14 to rotate the swing arm 14 clockwise in FIG. 2. When the swing arm 14 is drawn by the biasing spring 15 and thereby rotated clockwise in FIG. 2, the cleaning roller 3 is moved upward.

The swing arm 14 has a stopper portion 20. When the swing arm 13 is at a position illustrated in FIG. 1 or 2, the stopper portion 20 is in contact with the supporting member 21 to stop the clockwise rotation of the swing arm 14 caused by being drawn by the biasing spring 15. That is, the stopper portion 20 functions to set the upper limit of the position of the cleaning roller 3 to the position illustrated in FIG. 1 or 2.

An insertion member 13 for being inserted into the adhesive layer 4 is fixed to the supporting member 21 with a screw. The insertion member 13 is made into a, thin plate of stainless steel having proper elasticity. The insertion member 13 extends horizontally from an end of the supporting member 21 to a position just below the cleaning roller 3, where the insertion member 13 is perpendicularly bent upward. An end portion 13*a* of the insertion member 13 is positioned immediately below the cleaning roller 3.

Next, an operation of the belt cleaner 30 will be described together with an operation of each part of the ink-jet printer 1.

As illustrated in FIG. 1, when the ink-jet printer is in operation for printing, the conveyor belt 8 is at a position near the head main bodies 2*a* of the ink-jet heads 2 and upward distant from the cleaning roller 3. At this time, because the stopper portion 20 is in contact with the supporting member 21, the cleaning roller 3 is stopped at the upper limit position illustrated in FIG. 1 or 2 and the end portion 13*a* of the insertion member 13 is separated from the adhesive layer 4.

Figure 3:
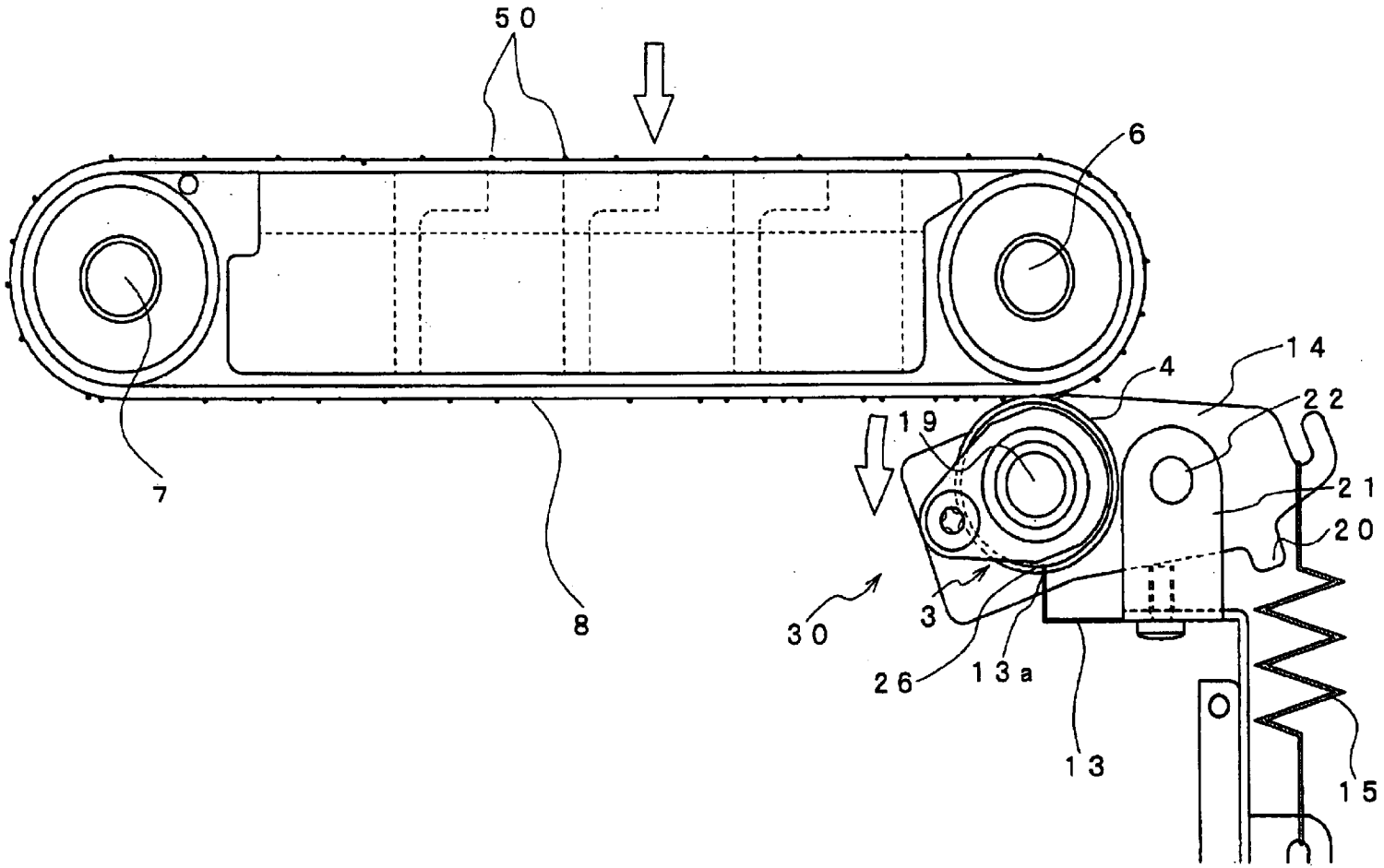
FIG. 3 illustrates a state wherein a cleaning roller of the belt cleaner is pushed down by a conveyor roller and simultaneously an insertion member is inserted into an adhesive layer.

When the conveyor belt 8 is moved down by the above-described lifting mechanism, the adhesive layer 4 is first brought into contact with the conveyor face of the conveyor belt 8. When the conveyor belt 8 is further moved down by a short distance from the above position, the cleaning roller 3 is pushed down by the conveyor belt 8 as illustrated in FIG. 3. At this time, the swing arm 14 is swung counterclockwise around the supporting shaft 22 against the biasing force of the biasing spring 15. In accordance with the swing of the swing arm 14, the end portion 13*a* of the insertion member 13 is inserted into the adhesive layer 4.

Figure 4:
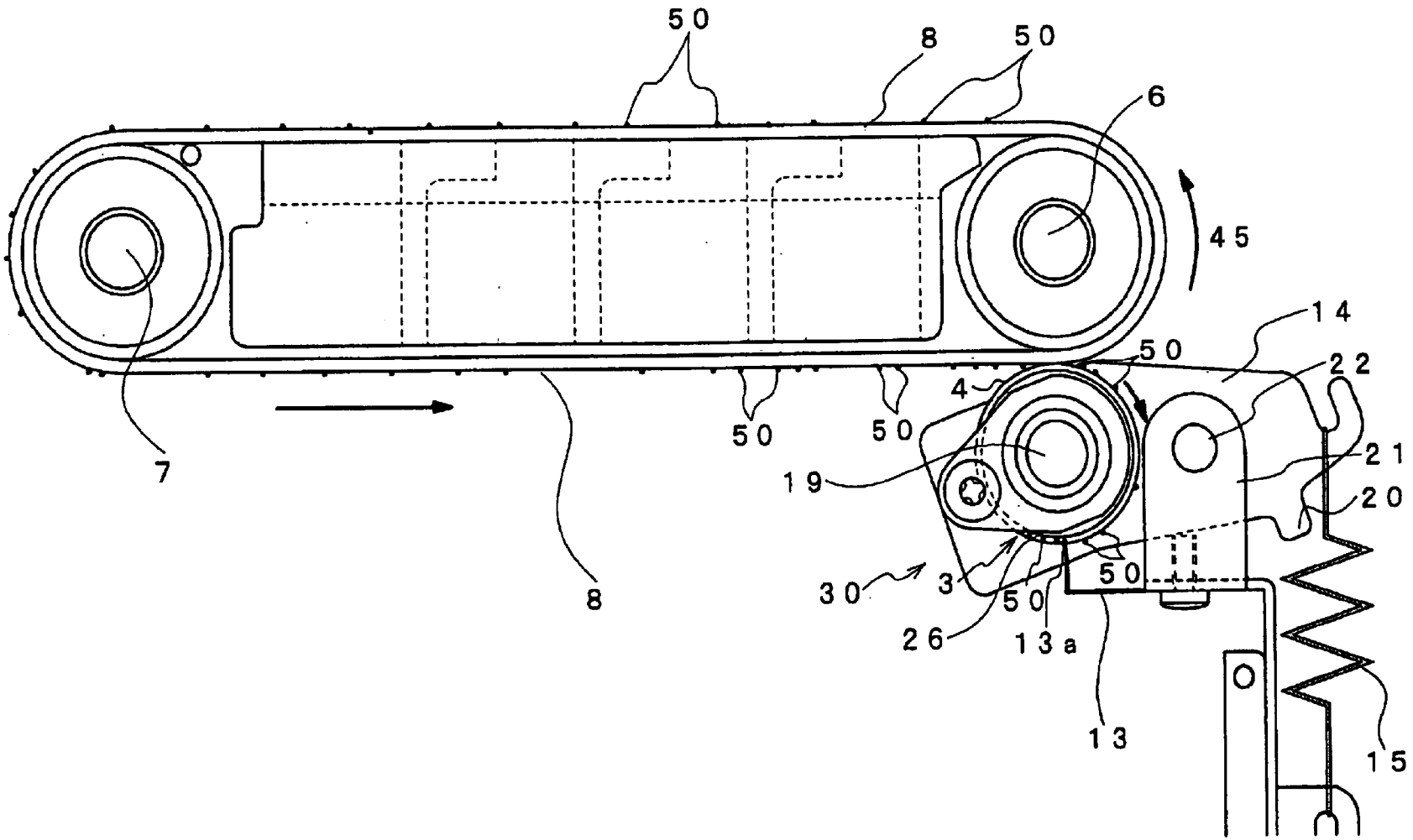
FIG. 4 illustrates a state wherein dust is transferred from a conveyor face of a conveyor belt to the adhesive layer, and furthermore, transferred dust is being caught in the interior of the adhesive layer by the insertion member.

In this state, as illustrated in FIG. 4, the belt roller 6 is rotated counterclockwise in FIG. 4 as indicated by an arrow 45 to drive the conveyor belt 8. The cleaning roller 3 is then rotated with the drive of the conveyor belt 8 because the adhesive layer 4 is in contact with the conveyor face of the conveyor belt 8. At this time, the biasing spring 15 is biasing the swing arm 14 so that the adhesive layer 4 is pressed onto the conveyor face of the conveyor belt 8. Thus, the cleaning roller 3 is rotated with the adhesive layer 4 being in contact with the conveyor face of the conveyor belt 8.

By thus rotating the cleaning roller 3, dust 50 adhering to the conveyor face of the conveyor belt 8 is transferred to the surface of the adhesive layer 4 and thereby removed from the conveyor face. As a result, the holding power of the conveyor face for paper, which has been lowered due to the dust 50, is recovered. Thus, the paper conveyance after this becomes sure and smooth again. In this case, because the adhesive layer 4 is formed by a viscous body, even if the dust 50 is placed in fine recesses on the conveyor face of the conveyor belt 8, the adhesive layer 4 can be deformed in accordance with the unevenness of the conveyor face to enter the recesses. Thus, the dust 50 can surely adhere to the adhesive layer 4 to be removed.

The viscosity of the adhesive forming the adhesive layer 4 is suitably determined in consideration of two conditions of removal efficiency of dust 50 and prevention of the adhesive layer 4 from dripping. If the viscosity of the adhesive is lowered, the adhesive layer 4 can be easily deformed in accordance with the unevenness of the conveyor face of the conveyor belt 8 and thus the removal efficiency of dust 50 is improved. In this case, however, the adhesive layer 4 is apt to gather on the lower side of the cleaning roller 3 and drop. Thus, by determining the viscosity of the adhesive forming the adhesive layer 4 while taking the competitive two conditions into consideration, dust 50 can be effectively removed without the adhesive layer 4 dripping.

At this time, on the lower side of the cleaning roller 3, as illustrated in FIG. 4, the end portion 13*a* of the insertion member 13 is inserted into the adhesive layer 4. Therefore, as the cleaning roller 3 is rotated, the dust having been transferred from the conveyor face of the conveyor belt 8 to the surface of the adhesive layer 4 gets caught in the adhesive layer 4. Thus, such a trouble as the adhesive force of the surface of the adhesive layer 4, i.e., the cleaning performance of the belt cleaner 30, is lowered due to accumulation of a great deal of dust 50 on the surface of the adhesive layer 4 can b prevented. In other words, the adhesive force of the surface of the adhesive layer 4, i.e., the cleaning performance of the belt cleaner 30, can be recovered. Thereby, fresh adhesive appears on the surface of the adhesive layer 4. Because the adhesive force of the surface of the adhesive layer 4, i.e., the cleaning performance of the belt cleaner 30, is kept good, dust can be stably removed from the conveyor belt 8. Therefore, replacement of cleaning member, for example, only the adhesive layer 4 or the cleaning roller 3 including the adhesive layer 4, need not frequently be performed. This decreases time, labor, and cost for maintenance.

Figure 5:
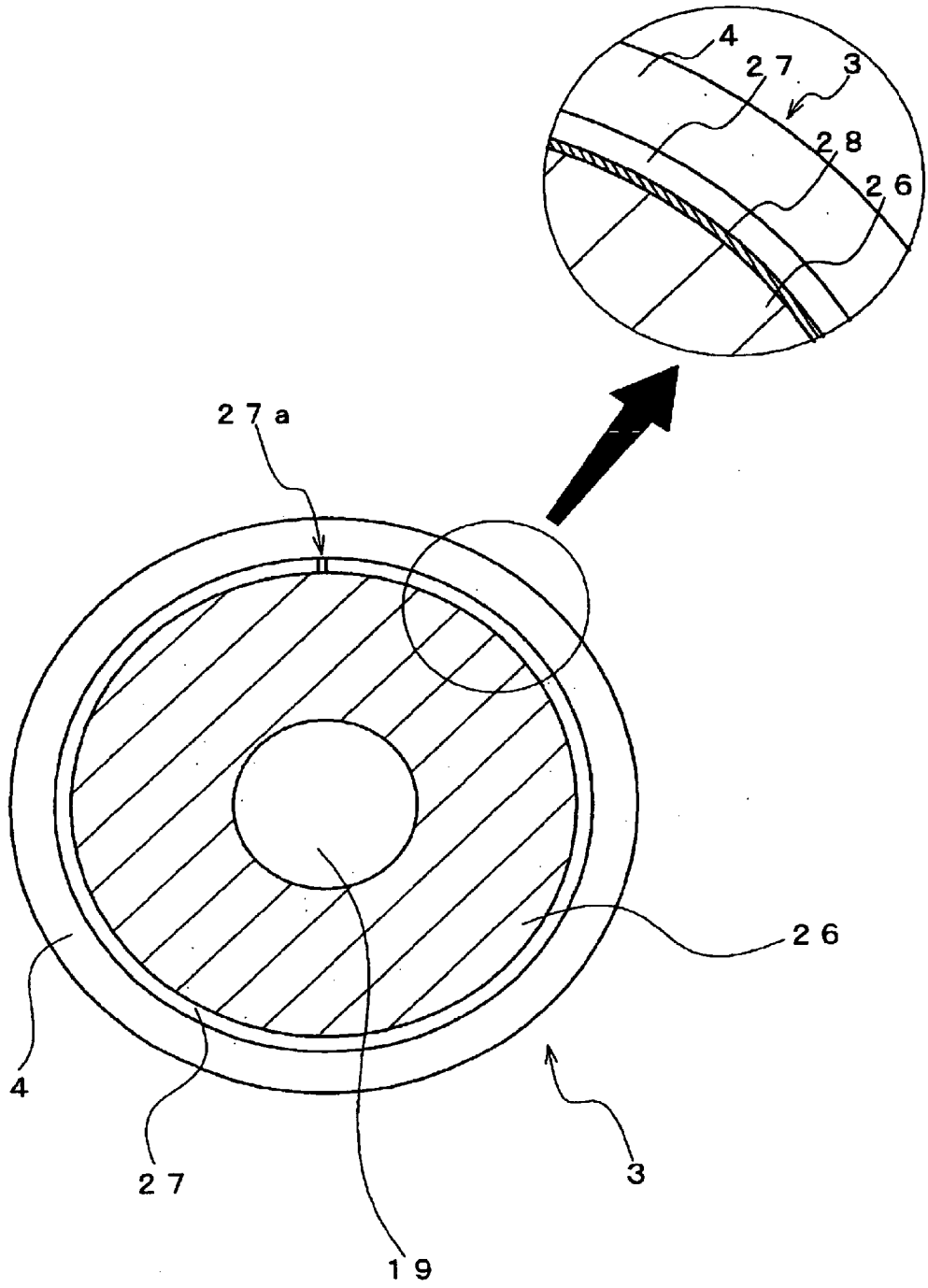
FIG. 5 is a cross-sectional view of the cleaning roller of FIG. 2.

Next, a specific structure of the cleaning roller 3 of this embodiment will be described with reference to FIG. 5.

The roller shaft 19 as the center of rotation of the cleaning roller 3 is made into a cylindrical bar of metal such as stainless steel or aluminum. The cylindrical roller body 26 made of a rubber or resin is fitted on the outer circumferential surface of the roller shaft 19. A sheet-shaped tape base 27 is wrapped around and bonded to the outer circumferential surface of the roller body 26. The adhesive layer 4 is provided on the outer surface of the tape base 27 opposite to the surface bonded to the roller body 26.

The tape base 27 is made into a sheet of urethane foam and has a length corresponding to the outer circumference of the roller body 26. As illustrated in an enlarged view in FIG. 5, before the tape base 27 is wrapped around the roller body 26, an adhesive is applied into a suitable thickness to one surface of the tape base 27 to form the adhesive layer 4 and a known adhesive 28 such as an acryl- or ether-base adhesive is applied to the other surface of the tape base 27. The tape base 27 is then wrapped around and bonded to the roller body 26 such that the surface to which the adhesive 28 has been applied faces the outer circumferential surface of the roller body 26. Thereby, the cleaning roller 3 whose circumferential surface is covered with the adhesive layer 4 is manufactured. By thus using the tape base 27, the adhesive layer 4 can be formed in a simple structure. This can decrease the number of steps and cost of manufacture.

If the tape base 27 entirely covers the outer circumferential surface of the roller body 26, the insertion member 13 is never caught in the tape base 27 while the cleaning roller 3 is rotated with the insertion member 13 being inserted into the adhesive layer 4. In this embodiment, however, the tape base 27 does not entirely cover the outer circumferential surface of the roller body 26 and has a seem 27*a*, as illustrated in FIG. 5. To prevent the insertion member 13 from being caught by the seem 27*a*, the seem 27*a* is preferably filled up with the adhesive of the adhesive layer 4.

Because the tape base 27 is made of urethane foam as described above, it is easily deformable. Therefore, when the adhesive layer 4 is brought into contact with the conveyor face of the conveyor belt 8, the tape base 27 supporting the adhesive layer 4 is easily deformed to follow the unevenness or inclination of the conveyor face of the conveyor belt 8. At this time, the adhesive layer 4 supported on the circumferential surface of the tape base 27 is also deformed to follow the unevenness or inclination of the conveyor face of the conveyor belt 8. As a result, the adhesive layer 4 can be uniformly in contact with the conveyor face of the conveyor belt 8. Thus, the followability of the adhesive layer 4 to the conveyor face of the conveyor belt 8 is improved and dust 50 can be effectively removed.

As a further effect of the tape base 27 made of a foamed material, the adhesive of the adhesive layer 4 can permeate into fine cavities. Thereby, the adhesive layer 4 can be stably held on the circumferential surface of the tape base 27 and prevented from dropping.

The tape base 27 may be made of a nonwoven fabric in place of a foamed material. Also in this case, the same effects as the case of using a formed material can be obtained. That is, like a foamed material, a nonwoven fabric is good in followability to the unevenness and inclination of the conveyor face of the conveyor belt 8 and the adhesive of the adhesive layer 4 can permeate the tape base 27. Also in this case obtained are the effect that the followability of the adhesive layer 4 to the conveyor face of the conveyor belt 8 is improved and thereby dust 50 can be effectively removed, and the effect that the adhesive layer 4 can be stably held on the circumferential surface of the tape base 27 and prevented from dropping.

Even if the tape base 27 is made of a material other than a foamed material and a nonwoven fabric, as far as the material of the tape base 27 has elasticity, the above-mentioned effect is obtained that the followability of the adhesive layer 4 to the conveyor face of the conveyor belt 8 is improved. The tape base 27 may be made of a material other than a foamed material and a nonwoven fabric and having no elasticity.

In the cleaning roller 3 of this embodiment, the adhesive layer 4 is provided on the circumferential surface of the tape base 27. However, the present invention is not limited to this structure. For example, the tape base 27 may not be used. Next, structures using no tape base 27 will be described with reference to FIGS. 6A and 6B.

Figure 6A:
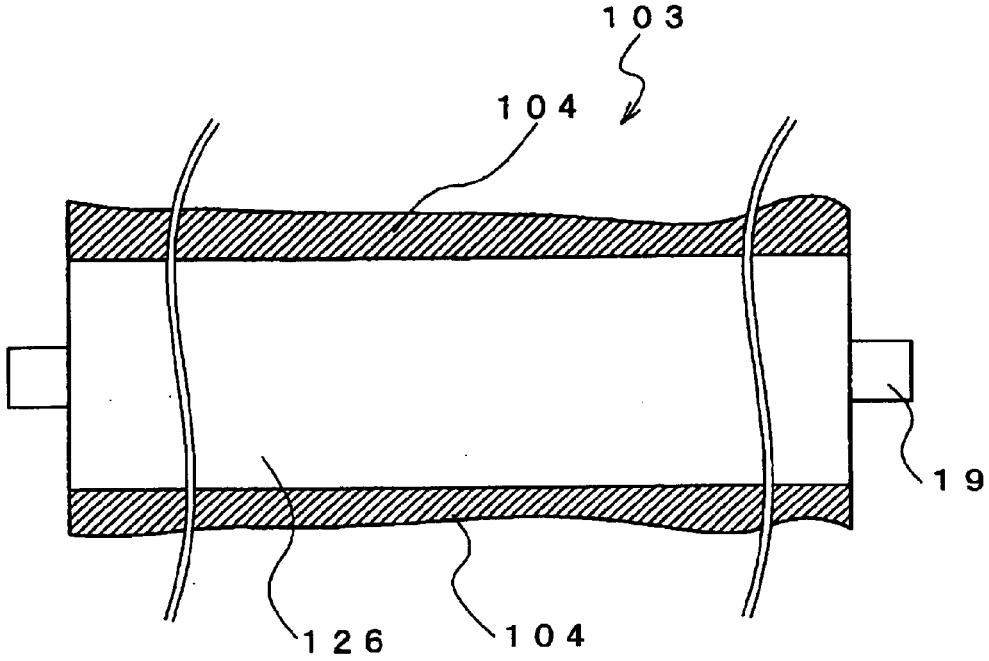
FIG. 6A is a vertical section of a modification of the cleaning roller including no tape base.
Figure 6B:
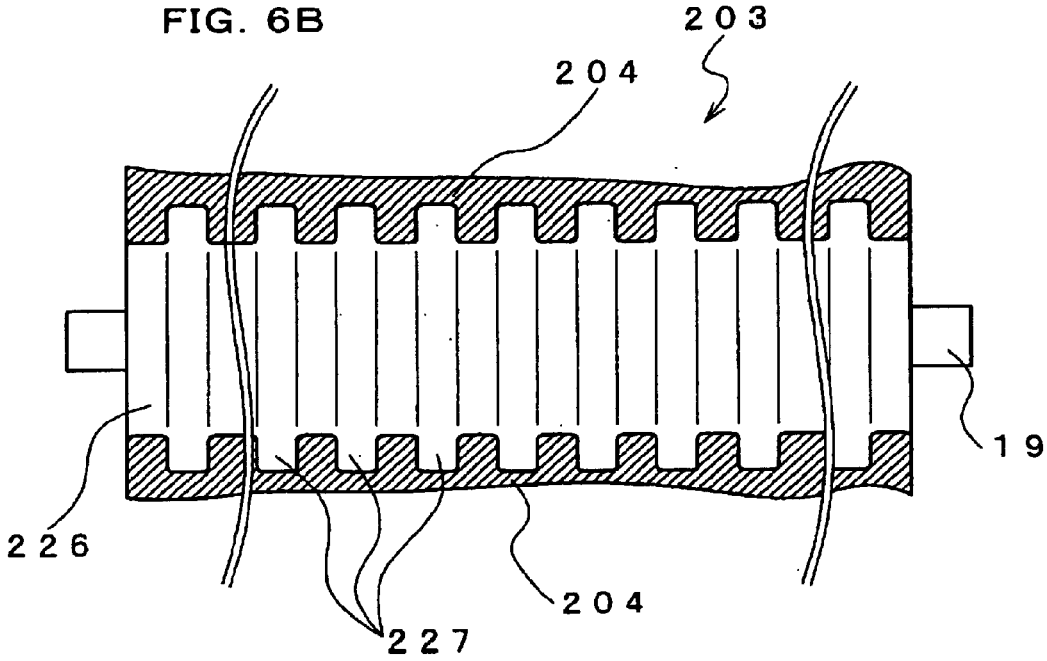
FIG. 6B is a vertical section of another modification of the cleaning roller including no tape base.

FIG. 6A illustrates a cleaning roller 103 as a modification. The cleaning roller 103 includes a roller body 126 having an even circumferential surface, and an adhesive layer 104 made of an adhesive having been applied directly to the circumferential surface of the roller body 126. FIG. 6B illustrates a cleaning roller 203 as another modification. The cleaning roller 203 includes a roller body 226 which has a plurality of projected portions 227. An adhesive layer 204 is provided on the uneven circumferential surface of the roller body 226. Comparing both modifications, the modification of FIG. 6B is preferable to the modification of FIG. 6A. This is because the circumferential surface area of the roller body 226 of FIG. 6B is larger than that of the roller body 126 of FIG. 6A and the adhesive can easily enter recesses on the circumferential surface of the roller body of FIG. 6B. As a result, in the modification of FIG. 6B, the adhesive layer 204 can be stably held on the circumferential surface of the roller body 226 and the adhesive layer 204 can effectively be prevented from dropping.

Unevenness formed on the circumferential surface of the roller body 226 is not limited to that of the modification of FIG. 6B in which a number of projected portions are formed. For example, a number of grooves are formed at regular intervals on the whole circumferential surface of the roller body 226. Or, a treatment for increasing the surface roughness, e.g., creping, is applied to the circumferential surface of the roller body 226 to form unevenness.

Next, drive of the cleaning roller 3 of this embodiment will be described. In this embodiment, the adhesive layer 4 is pressed onto the conveyor face of the conveyor belt 8 by biasing force of the biasing spring 15. In this state, by driving the conveyor belt 8, the cleaning roller 3 is driven by the conveyor belt 8 to rotate. In this construction, because the drive mechanism for the conveyor belt 8 can drive also the cleaning roller 3, no specific mechanism for driving the cleaning roller 3 is necessary. This can simplify the construction of the apparatus and decrease the manufacture cost.

Figure 7A:
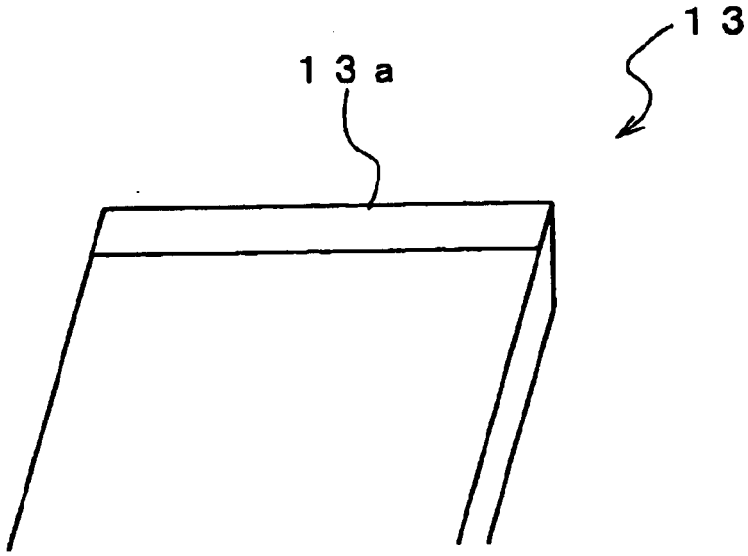
FIG. 7A is a perspective view of the insertion member having a blade-shaped end, included in the belt cleaner of FIG. 2.

In this embodiment, as illustrated in FIG. 7A, the end portion 13*a* of the insertion member 13, i.e., the portion to enter the adhesive layer 4, has a straight blade shape. However, the shape of the end portion 13*a* of the insertion member 13 is not limited to this.

Figure 7B:
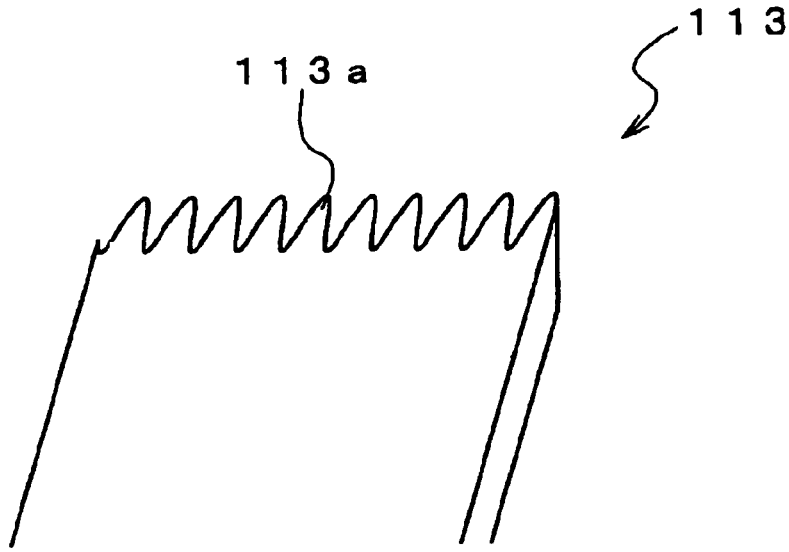
FIG. 7B is a perspective view of a modification of the insertion member.

For example, as illustrated in FIG. 7B, an insertion member 113 is usable having an end portion 113*a* jagged like a sawback. In such an end portion 113*a* having a jag, protrusions can enter the adhesive layer 4 more deeply and dust 50 on the surface of the adhesive layer 4 can get caught in the interior of the adhesive layer 4. Thereby, the adhesive force of the surface of the adhesive layer 4, i.e., the cleaning performance of the belt cleaner 30, can be surely and effectively recovered. Further, in case of using such an insertion member 113, because the adhesive of the adhesive layer 4 can pass through recesses of the end portion 113*a*, a problem can be avoided in which most part of the adhesive layer 4 is swept away so that the thickness of the adhesive layer 4 is decreased. Further, this modification is advantageous also on the points that the adhesive is scarcely caught upon passing through recesses of the end portion 113*a* and the generated resistance is not so high. The shape of the unevenness of the end portion of the insertion member is not limited to such a sawback shape as illustrated in FIG. 7B. The shape of the unevenness of the end portion of the insertion member can be various, for example, a brush shape.

A surface treatment for reducing adhesion to the adhesive layer 4 is preferably applied to the end portion 13*a* of the insertion member 13, i.e., the portion to be inserted into the adhesive layer 4. Thereby, separation of the insertion member 13 from the adhesive layer 4 is improved and thus the dust can more easily get caught in the adhesive layer 4. Further, because the resistance generated upon rotating the cleaning roller 3 is lowered, the load on the drive system for the conveyor belt 8 is relieved.

Figure 8A:
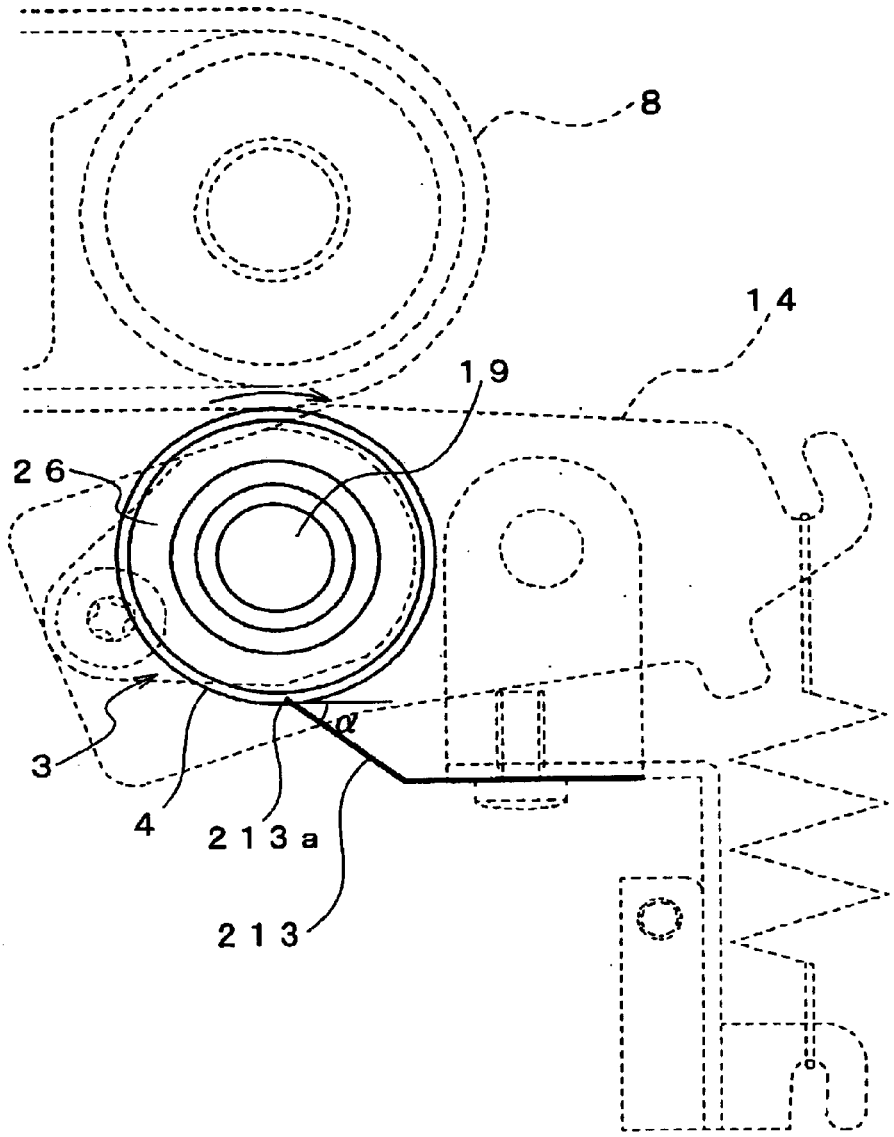
FIG. 8A illustrates an example in which the insertion member is inserted into the adhesive layer at an acute angle to a tangent to a circumferential surface of the adhesive layer.
Figure 8B:
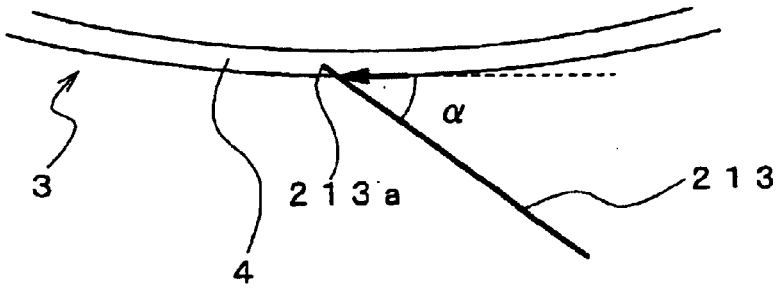
FIG. 8B is a partial enlarged view of FIG. 8A.
Figure 9A:
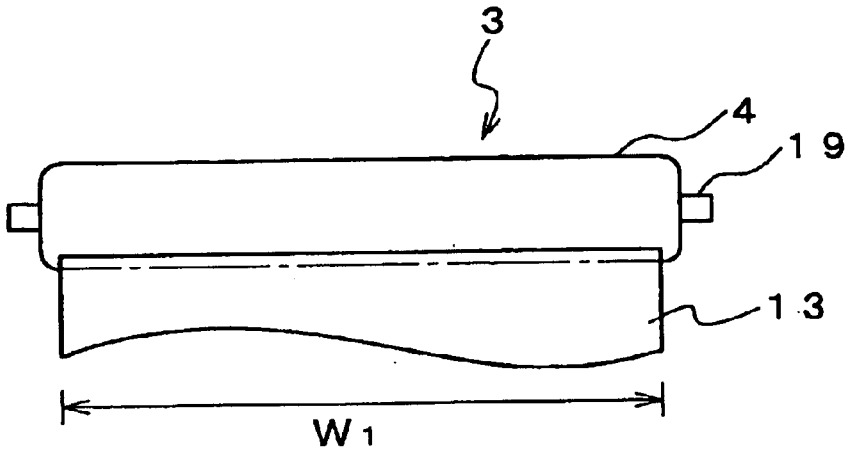
FIG. 9A is a side view illustrating a state wherein the wide insertion member of the belt cleaner of FIG. 2 is inserted into the adhesive layer.
Figure 9B:
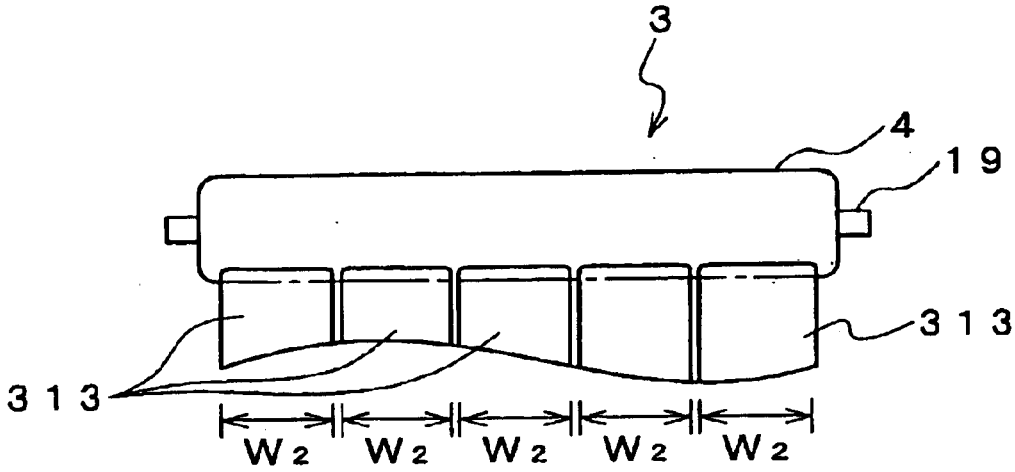
FIG. 9B is a side view illustrating an example in which a plurality of insertion members are inserted into the adhesive layer.

From the viewpoint of lowering the resistance generated upon rotating the cleaning roller 3, as illustrated in FIG. 8A, it is also effective to use an insertion member 213 having a end portion 213*a* extending at an angle alpha, which is an acute angle smaller than 90 degrees, to the rotating direction, indicated by an arrow in FIG. 8B, of the adhesive layer 4 caused by the rotation of the cleaning roller 3. In this case, the end portion 213*a* of the insertion member 213 is inserted into the adhesive layer 4 at an acute angle to a tangent to a circumferential surface of the adhesive layer 4. In this construction, while the cleaning roller 3 is rotated, the end portion 213*a* of the insertion member 213 is drawn along the adhesive layer 4 and thus prevented from entering the adhesive layer 4 more deeply than it is desired. Thereby, excessive resistance is prevented from being generated upon rotating the cleaning roller 3 with the insertion member 213 being inserted into the adhesive layer 4 and a trouble can be prevented in which overload is applied to the drive system for the conveyor belt 8, In this embodiment, as illustrated in FIG. 9A, the insertion member 13 is made of a single member having a width W1 somewhat smaller than the width of the adhesive layer 4. The insertion member 13 is inserted into the adhesive layer 4 in the substantially entire width of the adhesive layer 4. However, as illustrated in FIG. 9B, it is preferable to use insertion members 313 to independently inserted into regions W2 obtained by dividing the width of the adhesive layer 4. In case that the insertion members 313 are independently inserted into the respective regions W2 as illustrated in FIG. 9B, even if the surface of the adhesive layer 4 is uneven, the insertion members 313 can independently follow the unevenness. Therefore, dust can get caught in the adhesive layer 4 uniformly on the whole area of the adhesive layer 4. thus, fresh adhesive appears uniformly on the entire surface area of the adhesive layer 4. In place of using the plurality of independent insertion members 313 shown in FIG. 9B, a single insertion member may be used having a plurality end portions which are corresponding to the respective regions W2.

In case of using an insertion member made of a material having no elasticity, a specific means such as a biasing spring must be provided for causing the insertion member to be inserted into the adhesive layer. In this embodiment, however, because the insertion member 13 is made of a stainless steel plate having elasticity, such a specific means is unnecessary. Thus, the construction is simple and the manufacture cost can be reduced. Further, even if catching the end portion 13*a* of the insertion member 13 in the adhesive layer 4 is going to occur while the cleaning roller 3 is rotated, the insertion member 13 can be accordingly deformed to avoid being caught. Therefore, the drive system for the conveyor belt 8 for rotating the cleaning roller 3 is prevented from receiving an excessive load.

The elasticity of the insertion member 13 is suitably determined in consideration of the viscosity or the like of the adhesive layer 4 such that the end portion 13*a* of the insertion member 13 can be inserted into the adhesive layer 4 to a proper depth.

The adhesive layer 4 can be in two states of being in contact with the conveyor face of the conveyor belt 8 and of being separated from the conveyor face of the conveyor belt 8. That is, the adhesive layer 4 can be either in contact with the conveyor face of the conveyor belt 8 or separated from the conveyor face of the conveyor belt 8. A construction is thinkable in which the adhesive layer 4 covering the circumferential surface of the cleaning roller 3 is always in contact with the conveyor face of the conveyor belt 8. In this construction, however, when a long time elapses, a trouble may arise in which part of the adhesive layer 4 transfers to the conveyor face of the conveyor belt 8 or in which the adhesive layer 4 sticks to the conveyor face of the conveyor belt 8 so that the cleaning roller 3 can not rotate any longer. In this embodiment, however, the adhesive layer 4 is in contact with the conveyor face of the conveyor belt 8 only when cleaning is necessary, and separated from the conveyor face of the conveyor belt 8 when cleaning is unnecessary. Therefore, the above-described trouble can be avoided.

Also, the insertion member 13 can be in two states of being inserted into the adhesive layer 4 and of being separated from the adhesive layer 4. A construction is thinkable in which the insertion member 13 is always inserted into the adhesive layer 4. In this construction, however, when a long time elapses, a trouble may arise in which part of the adhesive layer 4 transfers to the insertion member 13 or in which the adhesive layer 4 sticks to the insertion member 13 so that the cleaning roller 3 can not rotate any longer. In this embodiment, however, the cleaning roller 3 is rotated with the insertion member 13 is being inserted into the adhesive layer 4 only when recovering the adhesive force of the surface of the adhesive layer 4, i.e., the cleaning performance of the belt cleaner 30, is necessary, and the insertion member 13 is separated from the adhesive layer 4 when recovering is unnecessary. Therefore, the above-described trouble can be avoided.

In this embodiment, the insertion member 13 comes to be inserted into the adhesive layer 4 substantially at the same time when the adhesive layer 4 gets into contact with the conveyor face of the conveyor belt 8, and the insertion member 13 comes to be separated from the adhesive layer 4 substantially at the same time when the adhesive layer 4 comes to be separated from the conveyor face of the conveyor belt 8. Thus, the insertion member 13 is inserted into the adhesive layer 4 while the adhesive layer 4 is in contact with the conveyor face of the conveyor belt 8, and the insertion member 13 is separated from the adhesive layer 4 while the adhesive layer 4 is separated from the conveyor face of the conveyor belt 8. Therefore, while the adhesive layer 4 is in contact with the conveyor face of the conveyor belt 8 to transfer dust to the surface of the adhesive layer 4, dust having been transferred to the surface of the adhesive layer 4 can get caught in the adhesive layer 4. Thereby, with the adhesive force of the surface of the adhesive layer 4, i.e., the cleaning performance of the belt cleaner 30, being kept good, cleaning the conveyor belt 8 can be surely performed. On the other hand, when the adhesive layer 4 is separated from the conveyor face of the conveyor belt 8 and cleaning the conveyor belt 8 is not performed, the insertion member 13 is also separated from the adhesive layer 4. Therefore, a trouble can be avoided in which deterioration of the adhesive layer 4 is accelerated due to bringing fresh adhesive to appear on the surface of the adhesive layer 4 more than necessary or in which part of the adhesive layer 4 transfers to the insertion member 13.

Figure 10A:
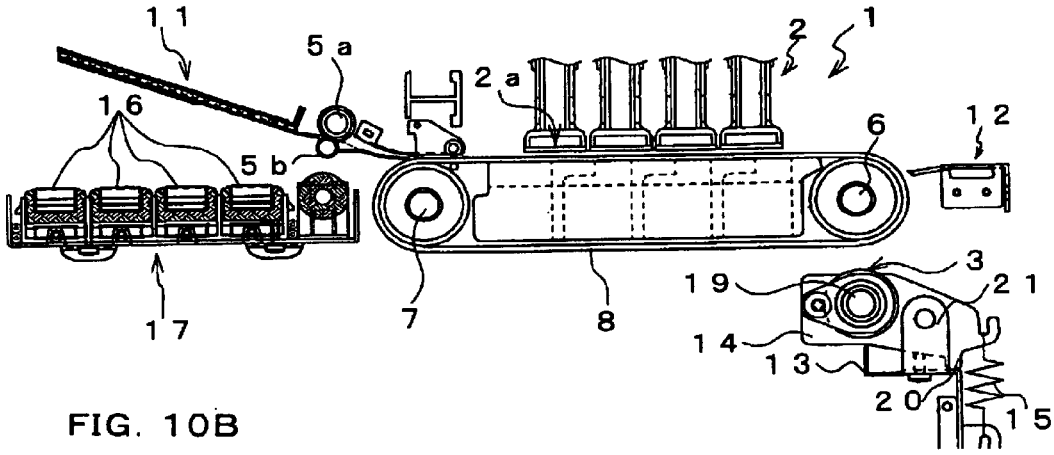
FIG. 10A illustrates a state wherein the ink-jet printer of FIG. 1 can perform printing.
Figure 10B:
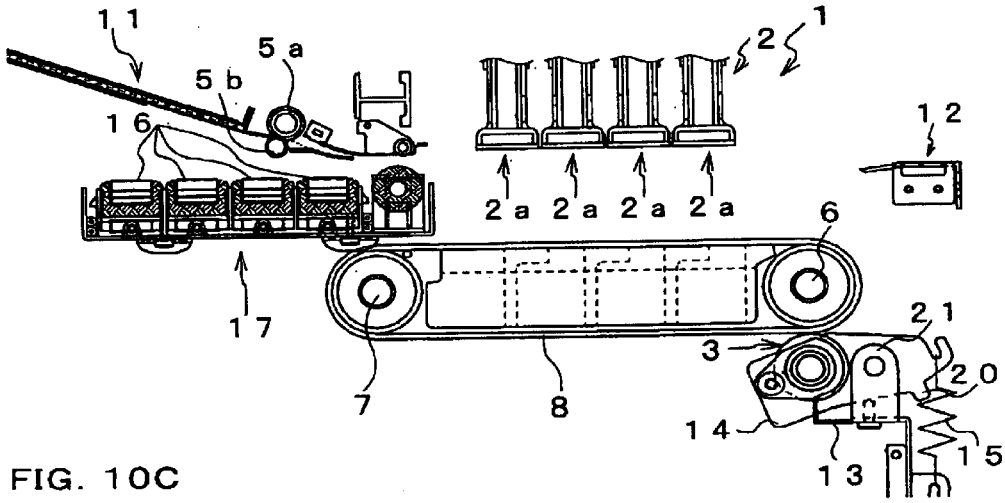
FIG. 10B illustrates a state immediately after a maintenance unit of the ink-jet printer of FIG. 1 starts to move.

In this embodiment, the adhesive layer 4 is either in contact with or separated from the conveyor face of the conveyor belt 8 in accordance with the upward and downward movements of the conveyor belt 8 upon movements of the maintenance unit 17 between the above-described withdrawal and cap positions (see FIG. 10B). This is a reasonable construction in which the operation for maintenance for the conveyor belt 8 is performed in parallel with a series of operations for maintenance for the ink-jet heads 2. This can shorten the time necessary for the maintenance work. In addition, because the lifting mechanism for moving the conveyor belt 8 can be also used for bringing the adhesive layer 4 into contact with the conveyor face of the conveyor belt 8 and separating the adhesive layer 4 from the conveyor face of the conveyor belt 8, any specific mechanism is unnecessary for bringing the adhesive layer 4 into contact with the conveyor face of the conveyor belt 8 and separating the adhesive layer 4 from the conveyor face of the conveyor belt 8. Thus, the construction can be simplified and the manufacture cost can be reduced.

Although various adhesives may be used for the adhesive layer 4, it is desirable to use an adhesive of non-silicon-base material such as an urethane- or acryl-base material. If a silicon-base material is used as the adhesive of the adhesive layer 4, when the adhesive layer 4 is in contact with the conveyor face of the conveyor belt 8, an excessive adhesive force is apt to appear between the adhesive layer 4 and the conveyor face of the conveyor belt 8 because the conveyor face of the conveyor belt 8 is made of silicone rubber as described above. Such an excessive adhesive force may hinder the movement of the conveyor belt 8 and the rotation of the cleaning roller 3. In this embodiment, however, because the adhesive layer 4 is made of a non-silicon-base material while the conveyor face of the conveyor belt 8 is made of silicone rubber, the above-described trouble can be avoided. Thus, the cleaning roller 3 can be smoothly rotated with the adhesive layer 4 being in contact with the conveyor face of the conveyor belt 8 and dust 50 on the conveyor face of the conveyor belt 8 can surely adhere to the adhesive layer 4 to be removed. Therefore, the cleaning efficiency is improved.

However, if the conveyor face of the conveyor belt 8 is made of a non-silicon-bas material, it is desirable to use a silicon-base material as the adhesive of the adhesive layer 4 in order to avoid the above-described trouble. That is, when one of the conveyor face of the conveyor belt 8 and the adhesive layer 4 is made of a silicon-base material, the other may be made of a non-silicon-base material. In this construction, as described above, dust on the conveyor face can surely adhere to the adhesive layer 4 to be removed and thereby the cleaning efficiency can be improved.

Figure 10C:
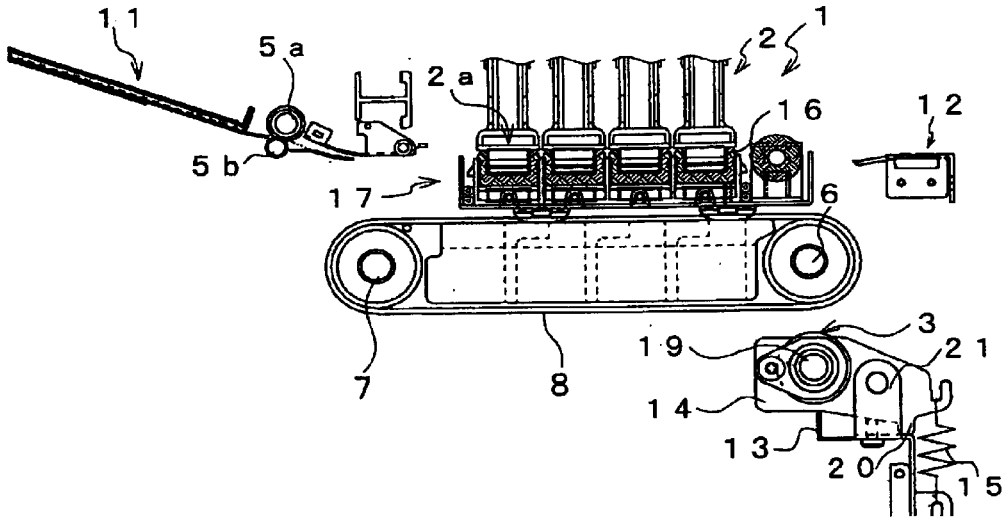
FIG. 10C illustrates a state wherein the maintenance unit is at a cap position.
Figure 11:
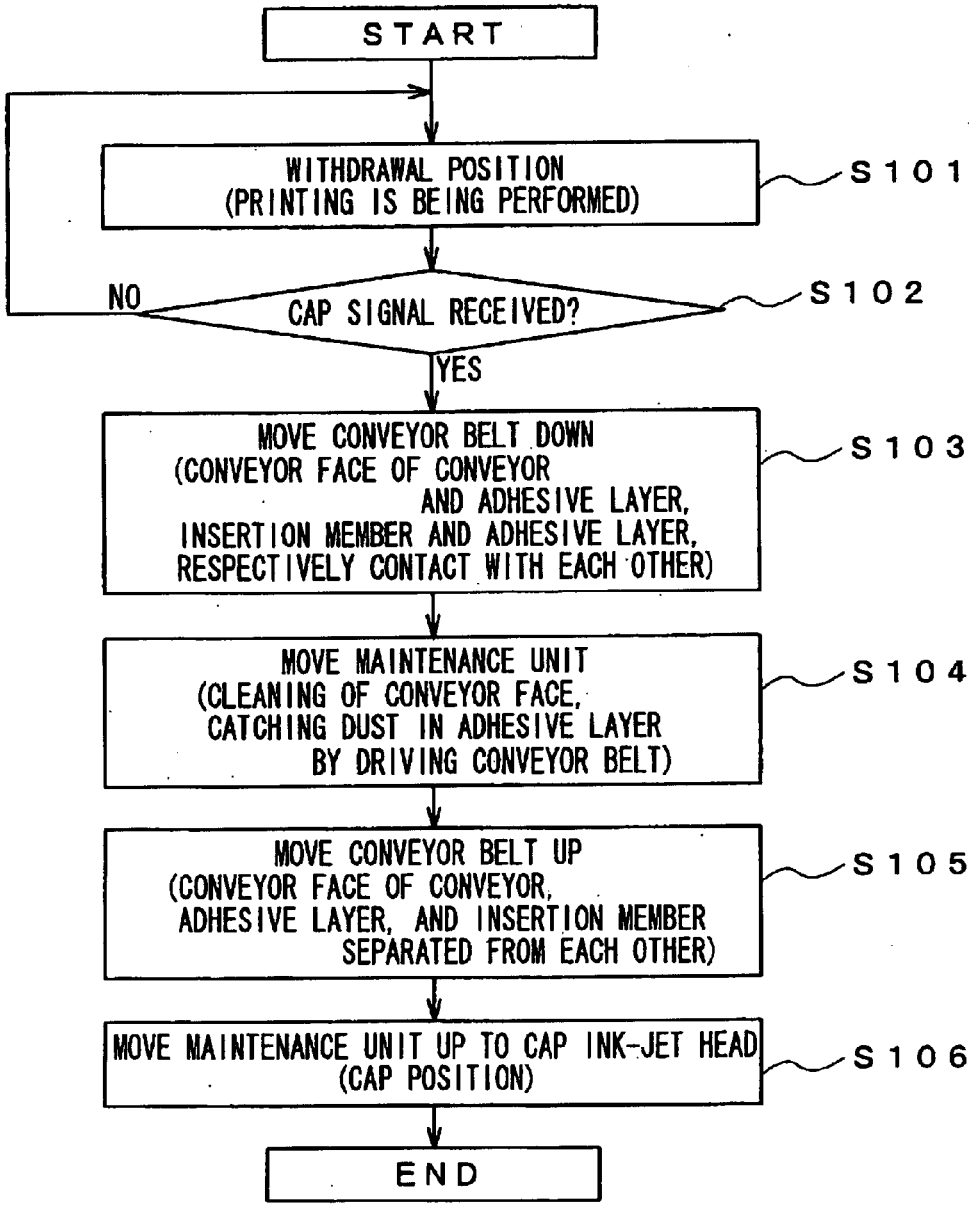
FIG. 11 is a flowchart of a capping operation of the maintenance unit.

Next, relation between a maintenance operation of the maintenance unit 17 and a cleaning operation of the cleaning roller 3 for the conveyor belt 8 will be described mainly with reference to FIGS. 10A, 10B, 10C, and 11. FIGS. 10A to 10C illustrate states of the ink-jet printer 1 in the order of time elapse. FIG. 11 is a flowchart of a capping operation of the maintenance unit 17.

The flowchart of FIG. 11 will be described first. In Step S101, the maintenance unit 17 is at the withdrawal position just below the paper feed unit 11 as illustrated in FIG. 10A. The conveyor belt 8 is at its uppermost position where a narrow clearance is formed between the conveyor face of the conveyor belt 8 and the lower face of the head main body 2*a* of each ink-jet head 2. At this time, the ink-jet printer 1 is in a state that the ink-jet printer 1 can perform printing or in a state that the ink-jet printer 1 is performing the printing. In the loop of Steps S101 and S102, the ink-jet printer 1 waits for a cap signal from a non-illustrated controller within the ink-jet printer 1 with keeping the state of positional relation illustrated in FIG. 10A.

The cap signal is issued by the non-illustrated controller when a state of receiving no print start instruction from an upper-order machine such as a personal computer connected to the ink-jet printer 1 continues for a predetermined time period after a printing operation is completed or the ink-jet printer 1 is powered on. When receiving the cap signal from the non-illustrated controller, the ink-jet printer 1 moves the conveyor belt 8 downward. Thereby, the conveyor belt 8 moves downward, and the adhesive layer 4 gets into contact with the conveyor face of the conveyor belt 8 and the insertion member 13 comes to be inserted into the adhesive layer 4, as described above.

When the downward movement of the conveyor belt 8 is completed, the ink-jet printer 1 controls a non-illustrated forwarding mechanism to move the maintenance unit 17 horizontally (see FIG. 10B). Thereby, the maintenance unit 17 is moved in a space between the conveyor belt 8 having moved down and the ink-jet heads 2 (Step S104). FIG. 10B illustrates a state immediately after the maintenance unit 17 starts to move.

Simultaneously with the start of the horizontal movement of the maintenance unit 17 from the withdrawal position toward the cap position, the conveyor belt 8 is driven. At this time, because the adhesive layer 4 is in contact with the conveyor face of the conveyor belt 8, the cleaning roller 3 starts to rotate and a cleaning operation for removing dust starts. Further, at the same time, dust starts to be caught in the adhesive layer 4 by the insertion member 13 on the lower side of the cleaning roller 3.

When the maintenance unit 17 moves to a position just below the head main bodies 2*a*, the horizontal movement of the maintenance unit 17 is completed. Simultaneously with this, the drive of the conveyor belt 8 is stopped and cleaning the conveyor belt 8 by the cleaning roller 3 and catching dust on the surface of the adhesive layer 4 in the interior thereof by the insertion member 13 are also stopped.

After that, the conveyor belt 8 is moved upward by the lifting mechanism (Step S105). By the upward movement of the conveyor belt 8, the conveyor face of the conveyor belt 8 and the adhesive layer 4, and the adhesive layer 4 and the insertion member 13 are separated from each other, respectively. As illustrated in FIG. 10C, the maintenance unit 17 is pushed up by the conveyor belt 8 moving upward, and brought to the cap position where the lower face of each head main body 2*a* is covered with a cap 16 (Step S106).

The maintenance unit 17 is at the cap position in the term in which it is expected that printing is not performed for a long time, for example, when the ink-jet printer 1 is powered off, as described above. While the maintenance unit 17 is at the cap position, it is expected that the conveyor belt 8 is not driven and stopped for a long time. Therefore, in case of a construction in which the adhesive layer 4 is always in contact with the conveyor face of the conveyor belt 8 or the insertion member 13 is always inserted into the adhesive layer 4, there is a high possibility that a trouble may arise in which part of the adhesive layer 4 transfers to the conveyor face of the conveyor belt 8, the adhesive layer 4 sticks to the conveyor face of the conveyor belt 8, or the like, as described above. In this embodiment, however, because the adhesive layer 4 and the insertion member 13 are separated from the conveyor face of the conveyor belt 8 and the adhesive layer 4, respectively, when the maintenance unit 17 is at the cap position, i.e., when the lower face of each head main body 2*a* is covered with the cap 16, the above trouble can he avoided.

In the above-described embodiment, a belt cleaner according to the invention is applied to an ink-jet printer. However, the present invention is not limited to this. For example, the present invention can be applied also to an ink-jet type facsimile or copying machine. Further, the present invention is not limited to be applied to an ink-jet type machine. For example, the present invention can be applied also to an electrophotographic type printer or the like.

Further, the object to be cleaned with the cleaning roller 3 is not limited to a belt. For example, the cleaning roller 3 and the insertion member 13 can be provided in a printer or the like of a type in which papers are conveyed with being held on a circumferential surface of a drum not a belt.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, hot limiting. Various changes may be made without departing from the spirit and scope of the invention as defined in the following claims.

What is claimed is:

1. A conveyor cleaner comprising:

an adhesive layer formed by a viscous body;

a cleaning roller having a circumferential surface covered with the adhesive layer; and an insertion member for insertion into the adhesive layer, wherein:

the cleaning roller is rotatable so that the adhesive layer can contact a conveyor face of a conveyor for conveying a medium during operation; and the insertion member can be inserted into the adhesive layer.

2. The conveyor cleaner according to claim 1, wherein a portion of the insertion member inserted into the adhesive layer has a jag.

3. The conveyor cleaner according to claim 1, wherein a surface treatment for reducing adhesion to the adhesive layer has been applied to a portion of the insertion member inserted into the adhesive layer.

4. The conveyor cleaner according to claim 1, wherein the insertion member can be inserted into the adhesive layer at an acute angle to a tangent to a circumferential surface of the adhesive layer.

5. The conveyor cleaner according to claim 1, wherein the insertion member has a plurality of parts arranged along an axis of the cleaning roller at least a portion of the insertion member being inserted into the adhesive layer.

6. The conveyor cleaner according to claim 1, wherein the insertion member is made of an elastic material.

7. The conveyor cleaner according to claim 1, wherein the insertion member can be either inserted into or separated from the adhesive layer.

8. The conveyor cleaner according to claim 7, wherein the insertion member is inserted into the adhesive layer when the adhesive layer is in contact with the conveyor face of the conveyor, and separated from the adhesive layer when the adhesive layer is separated from the conveyor face of the conveyor.

9. A conveyor cleaner comprising:

an adhesive layer formed by a viscous body; and a cleaning roller having a circumferential surface covered with the adhesive layer;

wherein the cleaning roller is rotatable so that the adhesive layer can contact a conveyor face of a conveyor for conveying a medium during operation, the adhesive layer can be positioned either in contact with or separated from the conveyor face of the conveyor in accordance with movement of the conveyor.

10. The conveyor cleaner according to claim 9, further comprising:

a swinging member supporting the cleaning roller and swingable in accordance with contact or separation between the adhesive layer and the conveyor face of the conveyor; and a biasing member for biasing the swinging member so that the adhesive layer is pressed onto the conveyor face of the conveyor.

11. The conveyor cleaner according to claim 10, further comprising an insertion member that can be either inserted into or separated from the adhesive layer in accordance with swing of the swinging member.

12. The conveyor cleaner according to claim 9, wherein the cleaning roller comprises a shaft having a center of rotation and a base body covering a circumferential surface of the shaft, and the adhesive layer is provided on a circumferential surface of the base body.

13. The conveyor cleaner according to claim 12, wherein the base body is made of one of a foam material and a nonwoven fabric.

14. The conveyor cleaner according to claim 12, wherein the base body is made of an elastic material.

15. The conveyor cleaner according to claim 12, wherein the base body entirely covers the circumferential surface of the shaft.

16. The conveyor cleaner according to claim 12, wherein the base body partially covers the circumferential surface of the shaft and a gap where the circumferential surface of the shaft is not covered with the base body is filled up with the adhesive layer.

17. The conveyor cleaner according to claim 9, wherein the cleaning roller is driven by driving of the conveyor.

18. The conveyor cleaner according to claim 9, wherein the circumferential surface of the cleaning roller has a plurality of projected portions in a region covered with the adhesive layer.

19. The conveyor cleaner according to claim 9, wherein the conveyor is a belt stretched between and wrapped around conveyor rollers, and the cleaning roller can be rotated with the adhesive layer being in contact with a wrapped portion of the conveyor face of the belt on one of the conveyor rollers.

20. The conveyor cleaner according to claim 9, wherein one of the conveyor face of the conveyor and the adhesive layer is made of a silicon-base material and the other is made of a non-silicon-base material.

21. An ink-jet printing apparatus comprising:

the conveyor cleaner according to claim 9;

a conveyor for conveying a medium; and an ink-jet head for ejecting ink onto the medium being conveyed by the conveyor.

22. The ink-jet printing apparatus according to claim 21, wherein the apparatus further comprises a cap for covering the ink-jet head, and the adhesive layer is separated from the conveyor face of the conveyor when the ink ejection face of the ink-jet head is covered with the cap.

23. A conveyor cleaner comprising:

a cleaning roller;

an adhesive layer formed by a viscous body and covering a circumferential surface of the cleaning roller; and a mechanism for moving a conveyor for conveying a medium so that the adhesive layer can be selectively positioned so that the adhesive layer is in contact with a conveyor face of the conveyor and positioned so that the adhesive layer is separated from the conveyor face of the conveyor, wherein the cleaning roller is rotatable so that the adhesive layer can contact the conveyor face.

24. A conveyor cleaner comprising:

an adhesive layer formed by a viscous body;

a cleaning roller having a circumferential surface covered with the adhesive layer, the cleaning roller being rotatable so that the adhesive layer can contact a conveyor face of a conveyor for conveying a medium; and a thin plate for insertion into the adhesive layer, wherein the cleaning roller is rotatable when the thin plate is inserted into the adhesive layer.

* * * * *